US007121811B2

(12) United States Patent
Hirota

(10) Patent No.: US 7,121,811 B2
(45) Date of Patent: Oct. 17, 2006

(54) CAPACITY CONTROL VALVE FOR VARIABLE DISPLACEMENT COMPRESSOR

(75) Inventor: Hisatoshi Hirota, Tokyo (JP)

(73) Assignee: TGK Co., Ltd., Tokyo (JP)

( * ) Notice: Subject to any disclaimer, the term of this patent is extended or adjusted under 35 U.S.C. 154(b) by 302 days.

(21) Appl. No.: 10/452,243

(22) Filed: Jun. 3, 2003

(65) Prior Publication Data

US 2003/0223884 A1 Dec. 4, 2003

(30) Foreign Application Priority Data

Jun. 4, 2002 (JP) ..... 2002-162608

(51) Int. Cl.
*F04B 1/26* (2006.01)

(52) U.S. Cl. ..... 417/222.2; 417/270; 62/228.5

(58) Field of Classification Search ..... 417/222.1, 417/222.2, 269, 270; 62/228.5, 228.3
See application file for complete search history.

(56) References Cited

U.S. PATENT DOCUMENTS 6,449,971 B1 * 9/2002 Kimura et al. ..... 62/228.3
6,457,319 B1 * 10/2002 Ota et al. ..... 62/228.3
6,514,049 B1 * 2/2003 Mera et al. ..... 417/222.2
6,662,581 B1 * 12/2003 Hirota et al. ..... 62/228.3
6,662,582 B1 * 12/2003 Hirota et al. ..... 62/228.3
6,663,356 B1 * 12/2003 Ota et al. ..... 417/222.2
6,746,214 B1 * 6/2004 Okada et al. ..... 417/222.2
6,769,667 B1 * 8/2004 Kume et al. ..... 251/129.18
6,804,970 B1 * 10/2004 Saeki et al. ..... 62/133
2002/0140881 A1 * 10/2002 Nakanishi et al. ..... 349/86
2002/0182087 A1 * 12/2002 Okii et al. ..... 417/222.2
2003/0024257 A1 * 2/2003 Hirota et al. ..... 62/228.3
2003/0035733 A1 * 2/2003 Hirota ..... 417/222.2
2003/0210988 A1 * 11/2003 Hirota ..... 417/222.2
2004/0074245 A1 * 4/2004 Nakazawa ..... 62/196.1
2004/0086391 A1 * 5/2004 Hirota et al. ..... 417/222.2

FOREIGN PATENT DOCUMENTS

JP 06213150 * 8/1994
JP 2001-132650 5/2001
JP 2003-35269 2/2003

* cited by examiner

*Primary Examiner*—William H. Rodríguez
(74) *Attorney, Agent, or Firm*—Westerman, Hattori, Daniels & Adrian, LLP.

(57) ABSTRACT

The object is to provide a capacity control valve for a variable displacement compressor, which is not adversely affected by pressure from a pressure-regulating chamber. The cross-sectional area of a valve hole of a high pressure-side valve seat for introducing discharge pressure Pd of a variable displacement compressor into a pressure-regulating chamber is A, the cross-sectional area of a valve hole of a low pressure-side valve seat for introducing pressure Pc1 (=Pc2) of the pressure-regulating chamber into a suction chamber is B, and the average cross-sectional area of a refrigerant passage assumed when a low-pressure valve element is open during most of control time of actual operation is b. A and B are set to A<B to make the effective pressure receiving area (≅A) of the high pressure-side valve and the effective pressure receiving area (≅B−b) of the low pressure-side valve approximately equal.

8 Claims, 5 Drawing Sheets

CAPACITY CONTROL VALVE FOR VARIABLE DISPLACEMENT COMPRESSOR

CROSS-REFERENCES TO RELATED APPLICATIONS, IF ANY

This application claims priority of Japanese Application No. 2002-162608 filed on Jun. 4, 2002 and entitled "Capacity Control Valve for a Variable Displacement Compressor".

BACKGROUND OF THE INVENTION (1) Field of the Invention

This invention relates to a capacity control valve for a variable displacement compressor, and more particularly to a capacity control valve for use in a variable displacement compressor for compressing a refrigerant gas in a refrigeration cycle of an automotive air conditioner.

(2) Description of the Related Art

A compressor used for compressing refrigerant in a refrigeration cycle of an automotive air conditioner is driven by an engine, and hence is not capable of controlling the rotational speed thereof. For this reason, a variable displacement compressor capable of changing the compression capacity for compressing refrigerant is employed so as to obtain adequate refrigerating capacity without being constrained by the rotational speed of the engine.

In such a variable displacement compressor, compression pistons are connected to a wobble plate fitted on a shaft driven for rotation by the engine, and the angle of the wobble plate is changed to change the stroke of the pistons for changing the discharge amount of the refrigerant, i.e. the capacity of the compressor.

The angle of the wobble plate is continuously changed by introducing part of the compressed refrigerant into a gastight pressure-regulating chamber and changing the pressure of the introduced refrigerant, thereby changing a balance between pressures applied to the both ends of each piston.

To control the amount of refrigerant introduced into the pressure-regulating chamber of the variable displacement compressor, in a compression capacity control device described e.g. in Japanese Unexamined Patent Publication No. 2001-132650, there have been proposed a construction in which a capacity control valve is disposed between a discharge chamber and a pressure-regulating chamber of the variable displacement compressor, and an orifice is provided between the pressure-regulating chamber and a suction chamber, and a construction in which an orifice is provided between a discharge chamber and a pressure-regulating chamber, and a capacity control valve is disposed between the pressure-regulating chamber and a suction chamber.

Each of the capacity control valves opens and closes the communication between the chambers such that a differential pressure across the capacity control valve is maintained at a predetermined value, and the capacity control valve is implemented by a solenoid control valve capable of externally setting the predetermined value of the differential pressure by a current value. Thus, when the engine rotational speed increases, the capacity control valve between the discharge chamber and the pressure-regulating chamber is opened, or the capacity control valve between the pressure-regulating chamber and the suction chamber is closed, whereby the pressure introduced into the pressure-regulating chamber is increased to reduce the volume of refrigerant that can be compressed, while when the engine rotational speed decreases, the capacity control valve is reversely controlled such that the pressure introduced into the pressure-regulating chamber is decreased to increase the volume of refrigerant that can be compressed, whereby the pressure of refrigerant discharged from the variable displacement compressor is maintained at a constant level irrespective of the engine rotational speed.

In such a capacity control valve for a variable displacement compressor, to minimize the operating capacity of the compressor, it is necessary to maximize the amount of refrigerant introduced from the discharge chamber into the pressure-regulating chamber or minimize the amount of refrigerant introduced from the pressure-regulating chamber into the suction chamber, and inversely, to maximize the operating capacity of the compressor, it is necessary to minimize the amount of refrigerant introduced from the discharge chamber into the pressure-regulating chamber or maximize the amount of refrigerant introduced from the pressure-regulating chamber into the suction chamber. If an orifice is provided between the discharge chamber and the pressure-regulating chamber or between the pressure-regulating chamber and the suction chamber of the compressor, the flow rate of refrigerant passing through the orifice is restricted. Therefore, when the operation of the compressor is changed from the maximum capacity operation to the minimum capacity operation or vice versa, the orifice limits the flow rate of refrigerant flowing from the discharge chamber to the pressure-regulating chamber or from the pressure-regulating chamber to the suction chamber, which causes much time to taken in transition to the minimum capacity operation or to the maximum capacity operation.

To eliminate this inconvenience, there is proposed a capacity control valve for a variable displacement compressor in Japanese Patent Application No. 2001-224209 which is arranged between a discharge chamber and a pressure-regulating chamber and between the pressure-regulating chamber and a suction chamber, for opening and closing communication between the discharge chamber and the pressure-regulating chamber and communication between the pressure-regulating chamber and the suction chamber, in an interlocked manner. This capacity control valve for a variable displacement compressor has a three-way valve construction in which two valves are arranged respectively between the discharge chamber and the pressure-regulating chamber and between the pressure-regulating chamber and the suction chamber, and when one of the valves is closed, the other is opened in a manner interlocked therewith, whereas when the one is opened, the other is closed in a manner interlocked therewith. The three-way valve is configured such that the high pressure-side valve arranged between the discharge chamber and the pressure-regulating chamber and the low pressure-side valve arranged between the pressure-regulating chamber and the suction chamber have the same effective pressure-receiving area so as to enable them to be moved only by the differential pressure between the discharge pressure and the suction pressure without being influenced by the pressure from the pressure-regulating chamber, and respective cross-sectional areas of refrigerant passages of the valves are made sufficiently larger than those of orifices. This makes it possible to cause a sufficiently large amount of refrigerant to flow during transition to the minimum capacity operation and the maximum capacity operation, which makes it possible to reduce the time taken for the transition.

Especially, when the compressor is operating in a state close to the minimum capacity operation, the refrigerant discharged from the discharge chamber is always introduced into the pressure-regulating chamber, so that the introduced refrigerant sometimes stays within the pressure-regulating chamber. In this state, to make a transition to the maximum capacity operation, it is desired to reduce the pressure within the pressure-regulating chamber as soon as possible. However, when the pressure-regulating chamber is communicated with the suction chamber to undergo a pressure drop in the pressure-regulating chamber, the refrigerant staying inside the pressure-regulating chamber is evaporated, and as long as the evaporation continues, the minimum capacity operation is maintained. Thus, it sometimes takes much time before the pressure in the pressure-regulating chamber actually drops. Even in such a case, since the three-way valve having large cross-sectional areas of the refrigerant passages fully opens the communication between the pressure-regulating chamber and the suction chamber, so that the refrigerant in the pressure-regulating chamber can be caused to promptly flow into the suction chamber, thereby reducing the time for transition from the minimum capacity operation to the maximum capacity operation.

However, although the high pressure-side valve and the low pressure-side valve of the conventional capacity control valve for a variable displacement compressor have the same effective pressure-receiving area, during most of actual operation, the valves are controlled such that the high pressure-side valve is fully closed and the low pressure-side valve is almost fully opened. Now, let it be assumed that the cross-sectional area of a valve hole of the high pressure-side valve is represented by A, the average cross-sectional area of a refrigerant passage of this valve when it is open by a, the cross-sectional area of a valve hole of the low pressure-side valve by B, and the average cross-sectional area of a refrigerant passage of this valve when it is open by b, the effective pressure-receiving area of the high pressure-side valve is represented by A−a, and the effective pressure-receiving area of the low pressure-side valve by B−b. During most of control time of actual operation, the effective pressure-receiving area of the high pressure-side valve is approximately equal to A, and that of the low pressure-side valve is equal to B−b, so that the high pressure-side valve and the low pressure-side valve are made to be different in effective pressure-receiving area, which causes the capacity control valve to be affected by the pressure from the pressure-regulating chamber.

SUMMARY OF THE INVENTION

The present invention has been made in view of these points, and an object thereof is to provide a capacity control valve for a variable displacement compressor which is unaffected by the pressure from the pressure-regulating chamber by making the effective pressure-receiving area A of the high pressure-side valve and the effective pressure-receiving area (B−b) of the low pressure-side valve in actual operation equal to each other.

To solve the above problem, the present invention provides a capacity control valve for a variable displacement compressor, for controlling an amount of refrigerant introduced from a discharge chamber into a pressure-regulating chamber, such that the differential pressure between a pressure in a suction chamber and a pressure in the discharge chamber is held at a predetermined differential pressure, to thereby change a volume of the refrigerant discharged from the variable displacement compressor, characterized by comprising a first valve inserted into a first refrigerant passage between a first port communicating with the discharge chamber and a second port communicating with the pressure-regulating chamber, for opening and closing the first refrigerant passage, and a second valve inserted into a second refrigerant passage between the second port communicating with the pressure-regulating chamber and a third port communicating with the suction chamber, the second valve having a larger diameter than a valve hole of the first valve, for opening and closing the second refrigerant passage in conjunction with the first valve.

The above and other objects, features and advantages of the present invention will become apparent from the following description when taken in conjunction with the accompanying drawings which illustrate preferred embodiments of the present invention by way of example.

DESCRIPTION OF THE PREFERRED EMBODIMENTS

Hereinafter, embodiments of the present invention will be described in detail with reference to the drawings.

Figure 1:
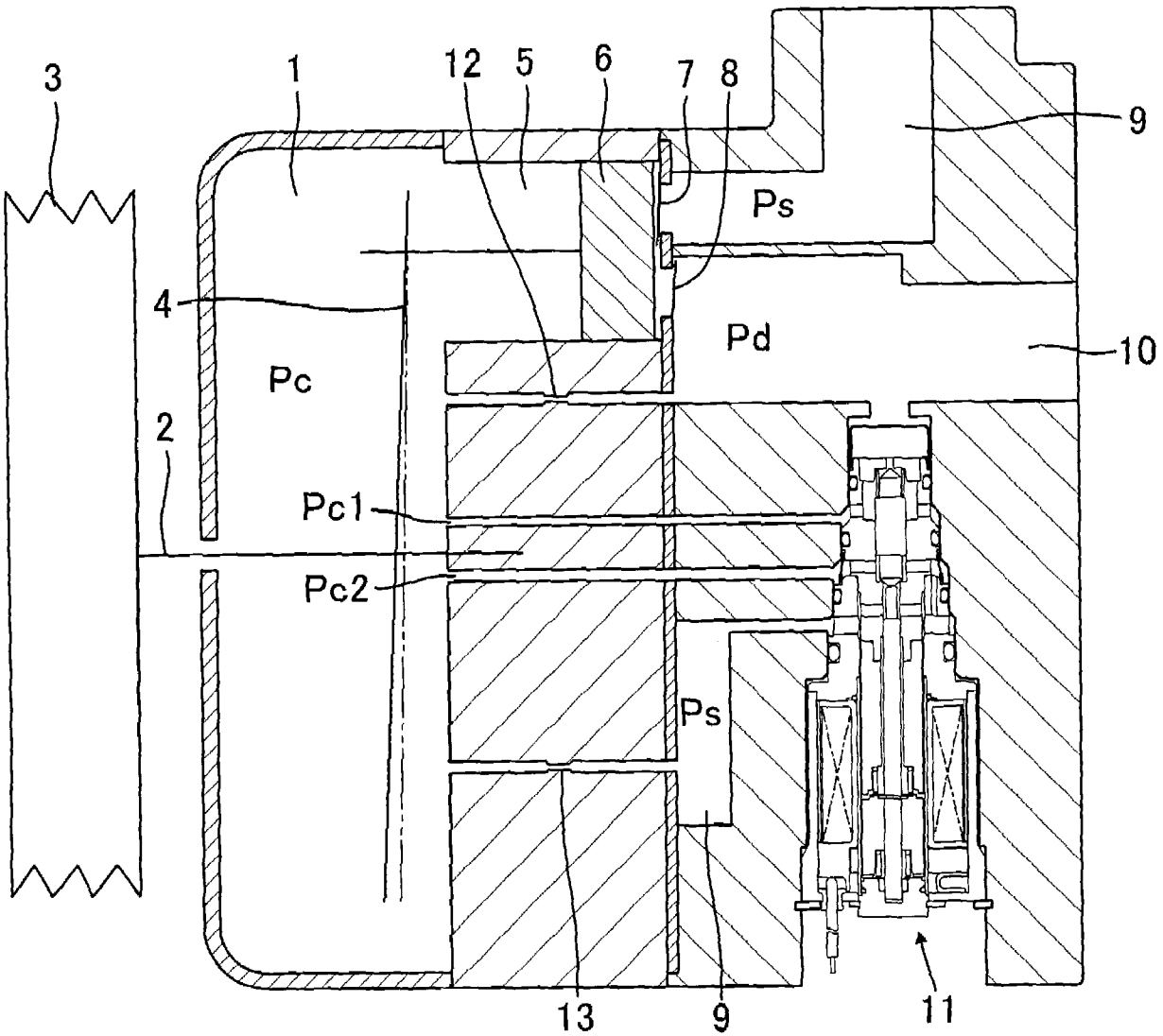
FIG. 1 is a cross-sectional view schematically showing the arrangement of a variable displacement compressor to which is applied a capacity control valve according to the invention.

FIG. 1 is a cross-sectional view schematically showing a variable displacement compressor to which is applied a capacity control valve according to the invention.

The variable displacement compressor includes a pressure-regulating chamber 1 formed gastight and a rotating shaft 2 rotatably supported in the pressure-regulating chamber 1. The rotating shaft 2 has one end extending outward from the pressure-regulating chamber 1 via a shaft sealing device, not shown, and having a pulley 3 fixed thereto which receives a driving force transmitted from an output shaft of an engine via a clutch and a belt. A wobble plate 4 is fitted on the rotating shaft 2 such that the inclination angle of the wobble plate 4 can be changed with respect to the axis of the rotating shaft 2. A plurality of cylinders 5 (only one of which is shown in the figure) are arranged around the axis of the rotating shaft 2. In each cylinder 5, there is arranged a piston 6 for converting rotating motion of the wobble plate 4 to reciprocating motion. Each of the cylinders 5 is connected to a suction chamber 9 and a discharge chamber 10 via a suction relief valve 7 and a discharge relief valve 8, respectively. The respective suction chambers 9 associated with the cylinders 5 communicate with each other to form one chamber which is connected to an evaporator of a refrigeration cycle. Similarly, the respective discharge chambers 10 associated with the cylinders 5 communicate with each other to form one chamber which is connected to a gas cooler or a condenser of the refrigeration cycle.

In the variable displacement compressor, a capacity control valve 11 including a three-way valve is arranged across respective intermediate portions of a refrigerant passage communicating between the discharge chamber 10 and the pressure-regulating chamber 1 and a refrigerant passage communicating between the pressure-regulating chamber 1 and the suction chamber 9. Between the discharge chamber 10 and the pressure-regulating chamber 1 and between the pressure-regulating chamber 1 and the suction chamber 9, there are arranged orifices 12, 13, respectively, for securing a minimum circulation amount of lubricating oil dissolved in refrigerant. Although the orifices 12, 13 are formed in the body of the variable displacement compressor, they may be formed in the capacity control valve 11.

In the variable displacement compressor constructed as above, as the rotating shaft 2 is rotated by the driving force of the engine, the wobble plate 4 fitted on the rotating shaft 2 rotates, and each piston 6 connected to the wobble plate 4 performs reciprocating motion. This causes refrigerant within the suction chamber 9 to be drawn into a cylinder 5, and compressed therein, and then the compressed refrigerant to be delivered to the discharge chamber 10.

Now, during normal operation, responsive to discharge pressure Pd of refrigerant discharged from the discharge chamber 10, the capacity control valve 11 controls the amount of refrigerant introduced into the pressure-regulating chamber 1 (pressure in the pressure-regulating chamber 1 at this time is indicated by Pc1 in the figure) and the amount of refrigerant introduced from the pressure-regulating chamber 1 into the suction chamber 9 (pressure in the pressure-regulating chamber 1 at this time is indicated by Pc2 in the figure) in an interlocked manner such that the differential pressure between the discharge pressure Pd and suction pressure Ps in the suction chamber 9 is held at a predetermined differential pressure. As a result, pressure Pc (=Pc1=Pc2) in the pressure-regulating chamber 1 is held at a predetermined value, whereby the capacity of each cylinder 5 is controlled to a predetermined value.

Further, during the minimum operation, the capacity control valve 11 fully opens the refrigerant passage for introducing refrigerant from the discharge chamber 10 to the pressure-regulating chamber 1 and fully closes the refrigerant passage for introducing refrigerant from the pressure-regulating chamber 1 to the suction chamber 9. At this time, although the capacity control valve 11 blocks the refrigerant passage from the pressure-regulating chamber 1 to the suction chamber 9, a very small amount of refrigerant flows via the orifice 13.

During the maximum operation, the capacity control valve 11 fully closes the refrigerant passage for introducing refrigerant from the discharge chamber 10 to the pressure-regulating chamber 1 and fully opens the refrigerant passage for introducing refrigerant from the pressure-regulating chamber 1 to the suction chamber 9. At this time, although the capacity control valve 11 blocks the refrigerant passage from the discharge chamber 10 to the pressure-regulating chamber 1, a very small amount of refrigerant is introduced into the pressure-regulating chamber 1 via the orifice 12 whereby lubricating oil contained in the refrigerant is supplied to the pressure-regulating chamber 1.

Next, the capacity control valve 11 according to the invention will be described in detail.

Figure 2:
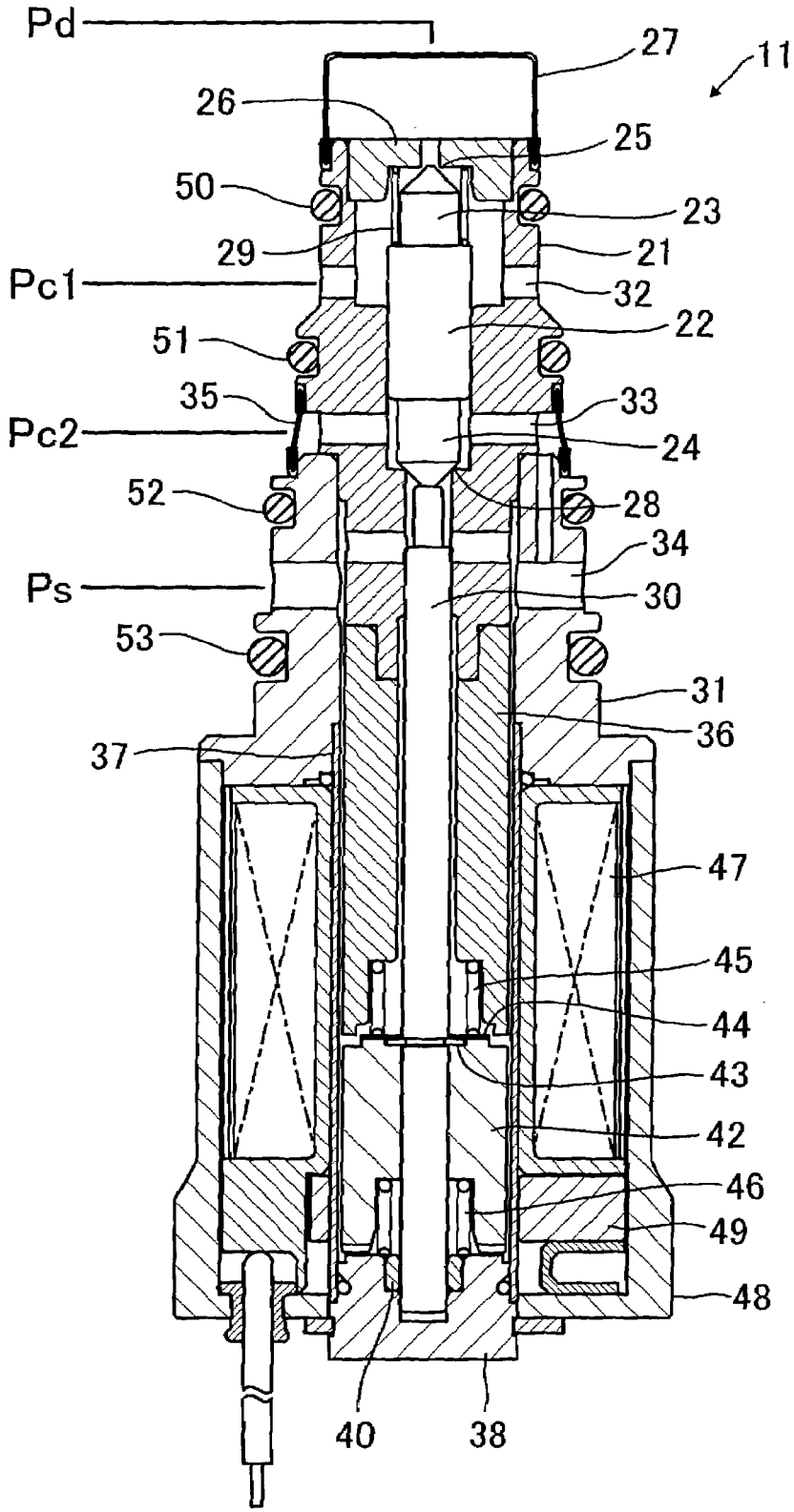
FIG. 2 is a central longitudinal sectional view showing a capacity control valve according to a first embodiment.

FIG. 2 is a central longitudinal sectional view showing a capacity control valve according to a first embodiment.

This capacity control valve 11 forms a three-way solenoid valve. More specifically, the capacity control valve 11 has a valve element 22 of a three-way valve, which is axially movably held in a central hole of a body 21. The valve element 22 has a high-pressure valve element 23 and a low-pressure valve element 24 integrally formed therewith at respective both ends thereof along the axis of the body 21.

A plug 26 forming a valve seat 25 for the high-pressure valve element 23 is fitted in an opening end of the central hole of the body 21 and a filter 27 is attached on the circumferential end of the body 21. The body 21 also has a valve seat 28 for the low-pressure valve element 24, integrally formed therewith along the axis thereof. Arranged between the plug 26 and the valve element 22 is a spring 29 for urging the valve element 22 in a direction in which the high-pressure valve element 23 is moved away from the valve seat 25 and at the same time in a direction in which the low-pressure valve element 24 is seated on the valve seat 28.

In this three-way valve, the diameter of a valve hole of the low pressure-side valve seat 28 is configured to be larger in size than that of a valve hole of the high pressure-side valve seat 25. That is, assuming that the cross-sectional area of the valve hole of the high pressure-side valve seat 25 is represented by A, and that of the valve hole of the low pressure-side valve seat 28 by B, the valve holes are configured such that A<B holds.

The valve hole of the valve seat 28 formed along the axis of the body 21 extends with the same inner diameter through the body 21 to a lower end portion thereof, as viewed in the figure. The through hole has a shaft 30 axially movably held therein. The shaft 30 has a reduced diameter at a portion toward the valve element 22 such that a refrigerant passage is formed between the portion and an inner wall of the through hole, and an upper end portion thereof is in abutment with the low-pressure valve element 24. The body 21 is fitted in a central hole of another body 31, and arranged on the same axis as the axis of the body 31.

It should be noted that a portion of the body 21 supporting the valve element 22 provides a partition between a space on high-pressure inlet side and a space on a low-pressure outlet side, and that ports 32, 33 are formed in the body 21 on a downstream side of the high-pressure valve element 23 and on an upstream side of the low-pressure valve element 24, respectively, in a manner corresponding to the two refrigerant passages communicating with the pressure-regulating chamber 1 of the variable displacement compressor. Further, a port 34 is formed in the body 31 on a downstream side of the low-pressure valve element 24 in a manner corresponding to a refrigerant passage communicating with the suction chamber 9 of the variable displacement compressor. A filter 35 is circumferentially arranged for an entrance to the port 33.

The body 31 has a solenoid arranged at a lower end thereof. The solenoid has a fixed core 36 whose upper end is fitted on a lower end of the body 21. To the lower end of the body 31 is rigidly secured an upper end of a sleeve 37. The sleeve 37 has a lower end thereof closed by a stopper 38. A guide 40 is fixed by press-fitting in a central space formed in an upper portion of the stopper 38. The guide 40 and a central through hole below the body 21 axially slidably support the shaft 30 by two-point support. A movable core 42 is arranged between the fixed core 36 and the stopper 38, and supported by the shaft 30. The movable core 42 has an upper end in abutment with an E ring 43 fitted on the shaft 30. Between the E ring 43 and the fixed core 36 are arranged a washer 44 and a spring 45, and between the stopper 38 and the movable core 42 is arranged a spring 46. A solenoid coil 47, a yoke 48, and a plate 49 for forming a closed magnetic circuit are arranged around the outer periphery of the sleeve 37.

Further, the body 21 has O rings 50, 51 arranged around the periphery thereof at respective upper and lower locations of the port 32, and the body 31 has O rings 52, 53 arranged around the periphery thereof at respective upper and lower locations of the port 34.

Now, let it be assumed that the cross-sectional area of a valve hole formed through the plug 26 for the high pressure-side valve is represented by A, the average cross-sectional area of a refrigerant passage of this valve assumed when the high-pressure valve element 23 is open by a, the cross-sectional area of a valve hole formed through the body 21 for the low pressure-side valve by B, and the average cross-sectional area of a refrigerant passage of this valve assumed when the low-pressure valve element 24 is open by b. When the valves open, the effective pressure-receiving areas thereof decrease, and therefore, the effective pressure-receiving area of the high pressure-side valve becomes equal to A−a, while the effective pressure-receiving area of the low pressure-side valve becomes equal to B−b. When the compressor is actually operated, during most of control time, the valve element 22 is positioned toward the closing position of the high-pressure valve element 23, so that the effective pressure-receiving area of the high pressure-side valve is approximately equal to A, whereas that of the low pressure-side valve is equal to B−b. Therefore, to prevent the capacity control valve from being adversely affected by the pressure Pc (=Pc1=Pc2) of the pressure-regulating chamber 1 under the condition of such valve lift, it is necessary to configure the valve such that A=B−b holds. That is, the cross-sectional area B of the valve hole formed through the body 21 for the low pressure-side valve is made larger than the cross-sectional area A of the valve hole formed through the plug 26 for the high pressure-side valve by the average cross-sectional area of the refrigerant passage of this valve assumed when the low-pressure valve element 24 is open. This makes the effective pressure receiving area A of the high pressure-side valve and the effective pressure receiving area (B−b) of the low pressure-side valve in actual operation approximately equal to each other. Accordingly, the pressures Pc1, Pc2 approximately equal to the pressure Pc in the pressure-regulating chamber 1 are applied to the respective pressure-receiving areas, equal to each other, of the high-pressure valve element 23 and the low-pressure valve element 24 in axially opposite directions, which cancels out influence of the pressure Pc on the valve element 22. This causes the three-way valve to be basically operated only by the differential pressure between the discharge pressure Pd supplied from the discharge chamber 10 and the suction pressure Ps supplied from the suction chamber 9 via the port 34.

Further, the suction pressure Ps in the port 34 is introduced into a space between the fixed core 36 and the movable core 42 through between the body 31 and the fixed core 36, and between the sleeve 37 and the fixed core 36, and further into a gap between the shaft 30 and the fixed core 36. Further, the suction pressure Ps in the port 34 is introduced into a space between the movable core 42 and the stopper 38 via a gap between the sleeve 37 and the movable core 42, and further into a space between the shaft 30 and the stopper 38 via a clearance between the shaft 30 and the guide 40, so that the inside of the solenoid is filled with the low suction pressure Ps.

In the capacity control valve 11 having the three-way valve configured as above, when no control current is supplied to the solenoid coil 47 of the solenoid, as shown in FIG. 2, the movable core 42 is urged by the spring 45 in a direction in which the movable core 42 is moved away from the fixed core 36, and the valve element 22 is urged toward the solenoid by the spring 29. Hence, the high-pressure valve element 23 is fully opened, whereas the low-pressure valve element 24 is fully closed. In this state, when the discharge pressure Pd is introduced, it is introduced into the pressure-regulating chamber 1 via the three-way valve. Since the refrigerant passage leading from the pressure-regulating chamber 1 to the suction chamber 9 is closed by the three-way valve, the pressure Pc1 of the pressure-regulating chamber 1 becomes closer to the discharge pressure Pd, which minimizes the difference between the pressures applied to the both end faces of the piston 6. As a result, the wobble plate 4 is controlled to an angle of inclination which minimizes the stroke of the pistons 6, whereby the operation of the variable displacement compressor is promptly switched to the minimum capacity operation.

When a maximum control current is supplied to the solenoid coil 47 of the solenoid, the movable core 42 is attracted by the fixed core 36 to be moved upward, as viewed in the figure, whereby the three-way valve has the high-pressure valve element 23 thereof fully close the passage associated therewith, and the low-pressure valve element 24 thereof fully open the passage associated therewith. Then, in addition to introduction of refrigerant from the pressure-regulating chamber 1 into the suction chamber 9 which has been effected via the orifice 13, refrigerant is guided into the suction chamber 9 from the port 33 communicating with the pressure-regulating chamber 1 via the three-way valve and the port 34. Therefore, the pressure Pc2 of the pressure-regulating chamber 1 becomes closer to the suction pressure Ps, which maximizes the difference between the pressures applied to the both end faces of the piston 6. As a result, the wobble plate 4 is controlled to an angle of inclination which maximizes the stroke of the pistons 6, whereby the variable displacement compressor is promptly switched to the maximum capacity operation.

During normal control in which a predetermined control current is supplied to the solenoid coil 47 of the solenoid, the movable core 42 is attracted by the fixed core 36 to be moved upward, as viewed in the figure, according to the magnitude of the control current. Thus, when the high-pressure valve element 23 is closed, only when the differential pressure between the discharge pressure Pd and the suction pressure Ps becomes larger than a value determined by the magnitude of the control current, the high-pressure valve element 23 is opened to start capacity control.

Figure 3:
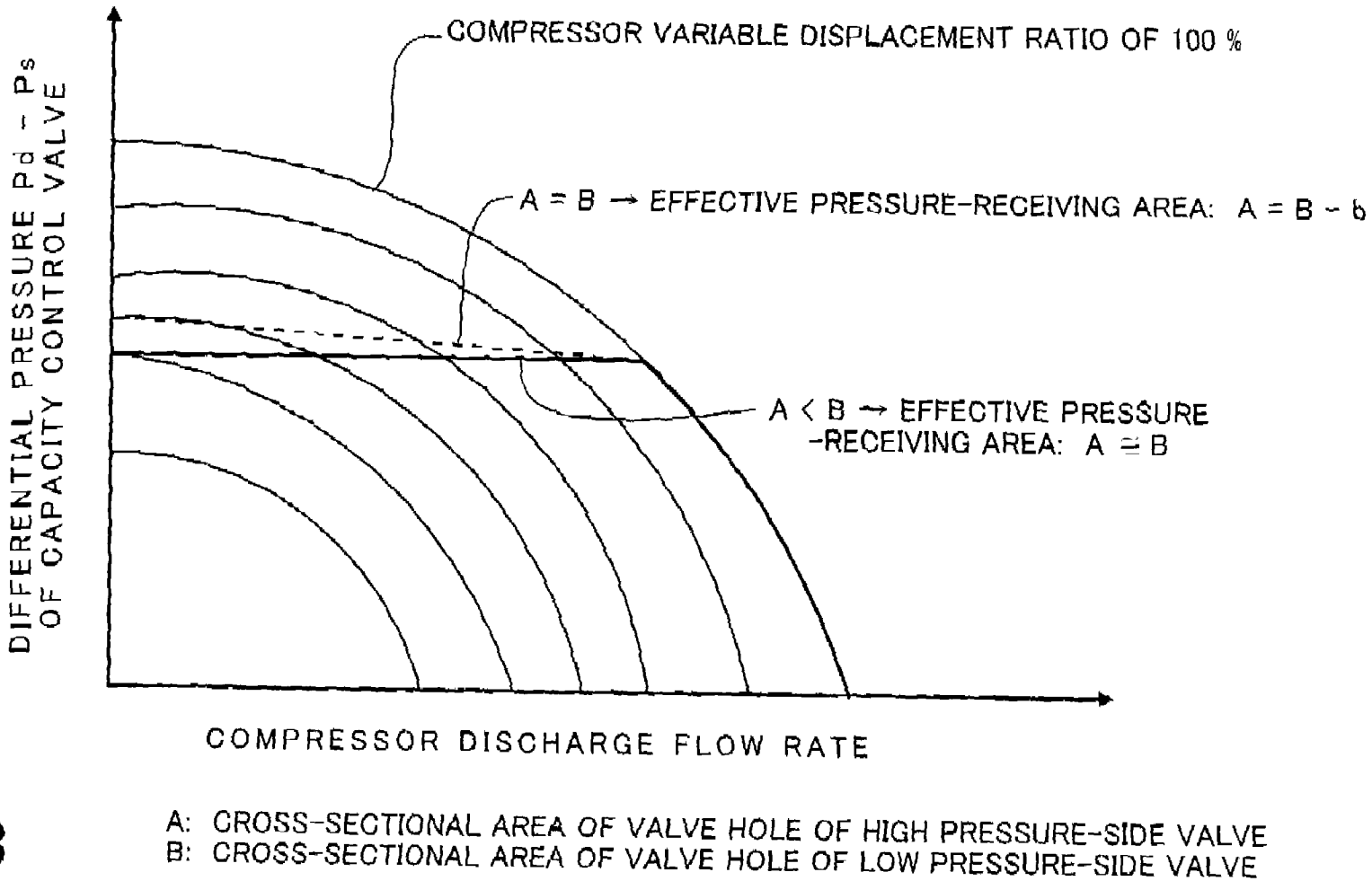
FIG. 3 is a diagram showing pump characteristics of the variable displacement compressor.

FIG. 3 is a diagram showing pump characteristics of the variable displacement compressor.

In the illustrated pump characteristics, the ordinate represents the differential pressure between the discharge pressure Pd and the suction pressure Ps of the capacity control valve 11, and the abscissa represents the discharge flow rate of the variable displacement compressor. Here, curves indicate compressor variable displacement ratios assumed when the variable displacement compressor is operating at certain rotational speeds, and a curve furthest from the origin indicates a compressor variable displacement ratio of 100%, i.e. maximum operation of the variable displacement compressor.

Let it be assumed that the current to be supplied to the solenoid coil 47 is set to such a value that the differential pressure between the discharge pressure Pd and the suction pressure Ps of the variable displacement compressor 11 becomes a certain value. If the variable displacement compressor starts its operation at this time, the discharge flow rate starts with a maximum flow rate with no differential pressure between the discharge pressure Pd and the suction pressure Ps, and thereafter, the differential pressure is progressively produced, and accordingly, the discharge flow rate of the refrigerant is progressively decreased, so that the operation of the variable displacement compressor follows the curve indicated by a compressor variable displacement ratio of 100%. Then, when the differential pressure between the discharge pressure Pd and the suction pressure Ps reaches the preset differential pressure, the high-pressure valve element 23 opens to introduce the discharge pressure Pd into the pressure-regulating chamber 1, whereby the pressure Pc in the pressure-regulating chamber 1 rises to cause the wobble plate 4 to move toward a position in which the wobble plate 4 is perpendicular to the rotating shaft 2, thereby starting to control the compressor in the compression capacity-decreasing direction. Thereafter, even when the discharge flow rate becomes small, the variable displacement compressor is controlled such that the differential pressure between the discharge pressure Pd and the suction pressure Ps is constant.

By the way, in the case of a capacity control valve configured such that the cross-sectional area A of a valve hole for a high pressure-side valve and the cross-sectional area B of a valve hole for a low pressure-side valve have the same size, during most of control time in actual operation, the effective pressure-receiving area of the high pressure-side valve is approximately equal to A and the effective pressure-receiving area of the low pressure-side valve is equal to B−b, and the capacity control valve is influenced by the pressure Pc of the pressure-regulating chamber 1 by the difference in the areas. Therefore, within the variable displacement range, as the discharge capacity decreases, the differential pressure Pd−Ps tends to become large. In contrast, when the effective pressure receiving areas A and B are set, by taking into account the average cross-sectional area b of a refrigerant passage of the low pressure-side valve assumed when the low-pressure valve element 24 is open, such that A<B holds, the effective pressure-receiving areas of the high pressure-side and low pressure-side valves become approximately equal to each other during most of control time in actual operation. This prevents the capacity control valve from being adversely affected by the pressure Pc of the pressure-regulating chamber 1, and causes the same to have a characteristic of the differential pressure Pd−Ps being constant irrespective of the discharge capacity in any position in the variable displacement range, to provide a capacity control valve excellent in differential pressure properties.

Figure 4:
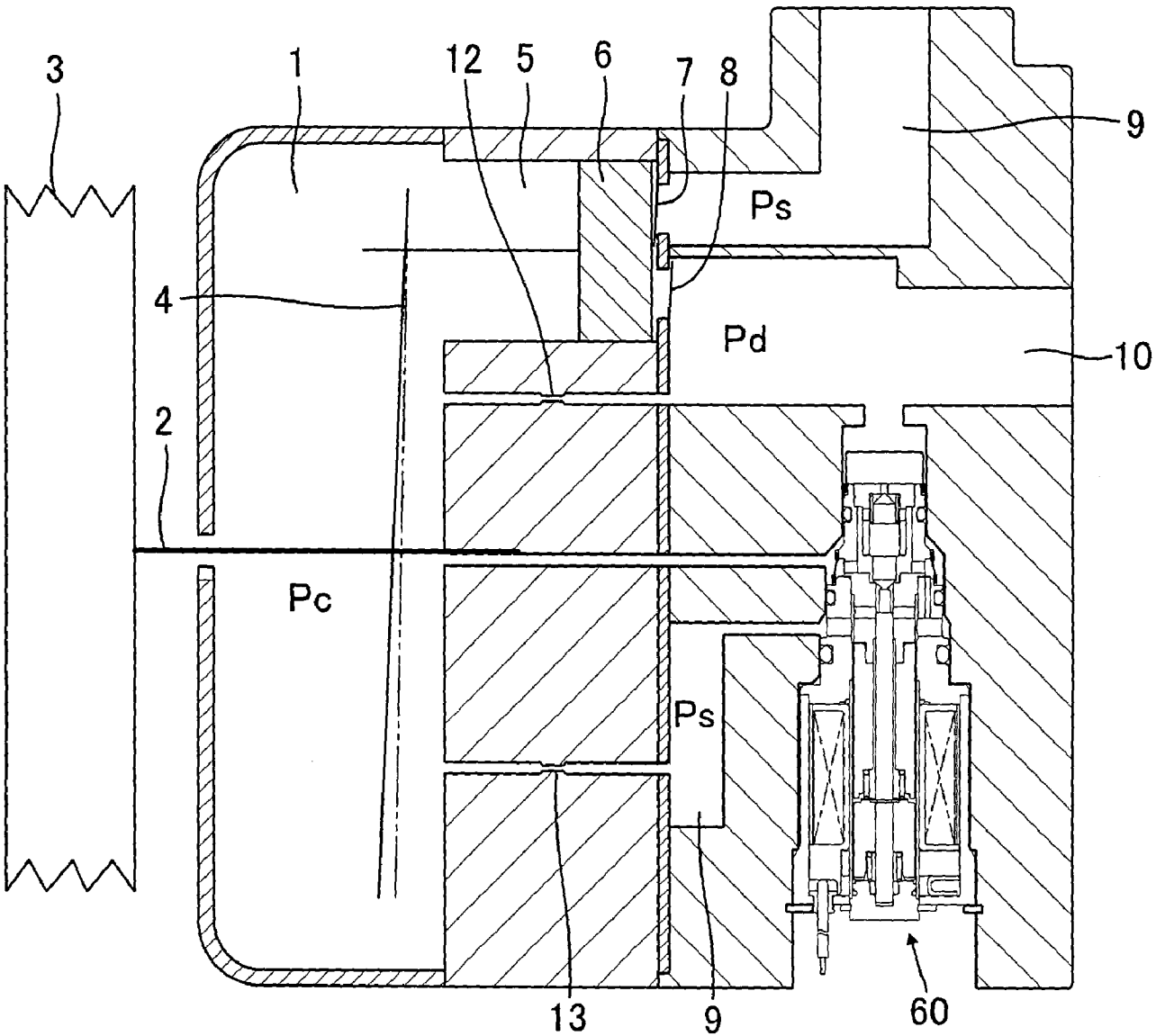
FIG. 4 is a cross-sectional view schematically showing the arrangement of a variable displacement compressor to which is applied another capacity control valve according to the invention.

FIG. 4 is a cross-sectional view schematically showing the arrangement of a variable displacement compressor to which is applied another capacity control valve according to the invention. In FIG. 4, component parts and elements similar to those shown in FIG. 1 are designated by identical reference numerals, and detailed description thereof is omitted.

In this variable displacement compressor, a capacity control valve 60 including a three-way valve is arranged across respective intermediate portions of a refrigerant passage communicating between a discharge chamber 10 and a pressure-regulating chamber 1 and a refrigerant passage communicating between the pressure-regulating chamber 1 and a suction chamber 9. Further, one common refrigerant passage is provided between the capacity control valve 60 and the pressure-regulating chamber 1.

In the variable displacement compressor constructed as above, as a rotating shaft 2 is rotated by the driving force of the engine, a wobble plate 4 fitted on the rotating shaft 2 rotates, and each piston 6 connected to the wobble plate 4 performs reciprocating motion. This causes refrigerant within the suction chamber 9 to be drawn into a cylinder 5, and compressed therein, and the compressed refrigerant to be delivered to the discharge chamber 10.

At this time, during normal operation, responsive to discharge pressure Pd of refrigerant discharged from the discharge chamber 10, the capacity control valve 60 controls the amount of refrigerant introduced into the pressure-regulating chamber 1, and the amount of refrigerant bypassed to the suction chamber 9, which is part of the refrigerant to be introduced into the pressure-regulating chamber 1, such that the differential pressure between the discharge pressure Pd and suction pressure Ps from the suction chamber 9 is held at a predetermined pressure. As a result, pressure Pc in the pressure-regulating chamber 1 is held at a predetermined value, whereby the capacity of each cylinder 5 is controlled to a predetermined value. After that, the pressure Pc in the pressure-regulating chamber 1 is returned to the suction chamber 9 via an orifice 13.

During the minimum operation, the capacity control valve 60 fully opens the refrigerant passage for introducing refrigerant from the discharge chamber 10 to the pressure-regulating chamber 1 and fully closes the refrigerant passage for introducing refrigerant from the pressure-regulating chamber 1 to the suction chamber 9. At this time, although the capacity control valve 60 blocks the refrigerant passage from the pressure-regulating chamber 1 to the suction chamber 9, a very small amount of refrigerant flows via the orifice 13.

During the maximum operation, the capacity control valve 60 fully closes the refrigerant passage for introducing refrigerant from the discharge chamber 10 into the pressure-regulating chamber 1 and fully opens the refrigerant passage for introducing refrigerant from the pressure-regulating chamber 1 into the suction chamber 9. At this time, although the capacity control valve 60 blocks the refrigerant passage from the discharge chamber 10 to the pressure-regulating chamber 1, a very small amount of refrigerant is introduced into the pressure-regulating chamber 1 via an orifice 12 such that lubricating oil contained in the refrigerant is supplied to the pressure-regulating chamber 1.

Next, the capacity control valve 60 for carrying out the above control operations will be described in detail.

Figure 5:
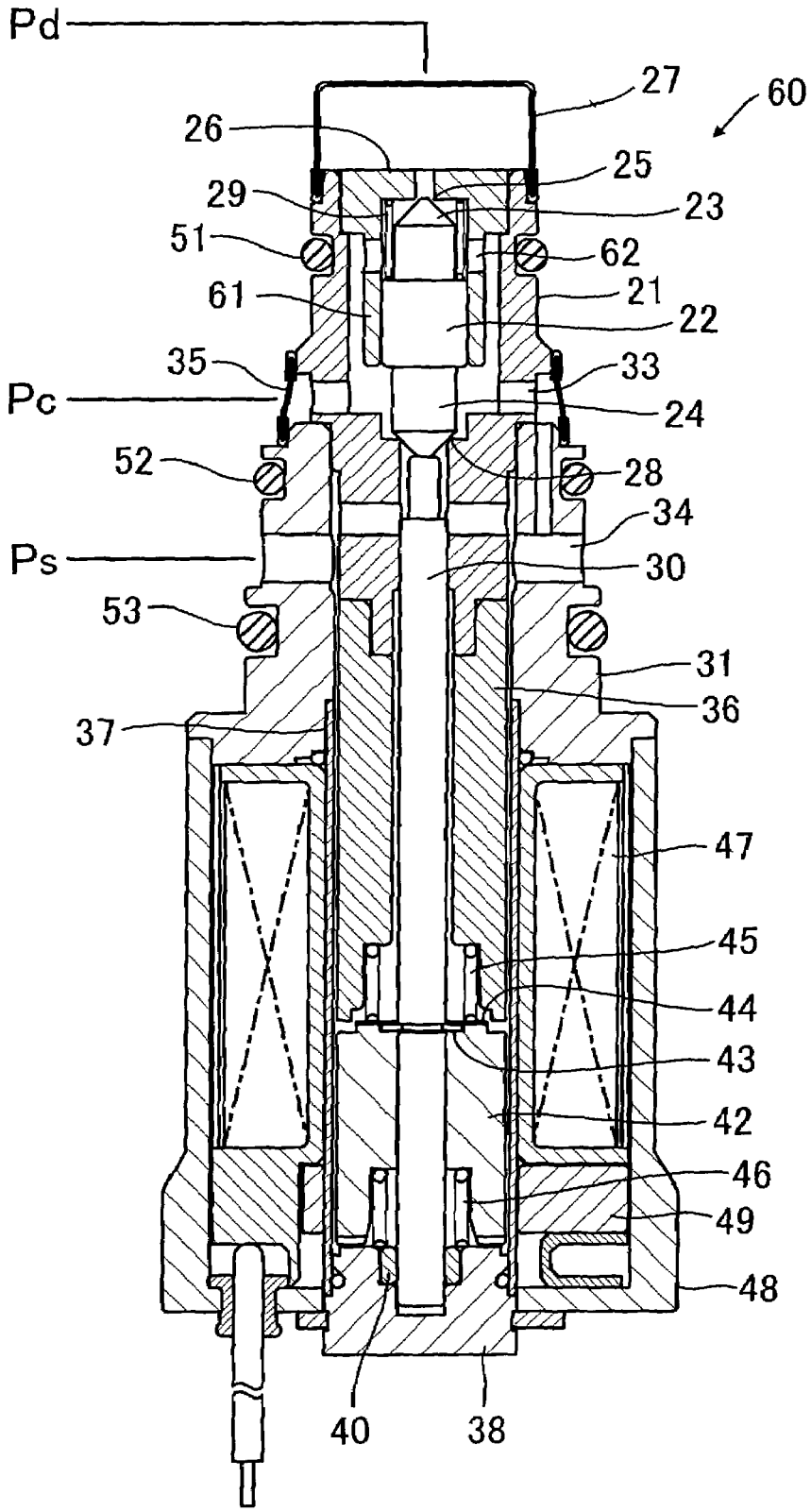
FIG. 5 is a central longitudinal sectional view showing a capacity control valve according to a second embodiment.

FIG. 5 is a central longitudinal sectional view showing a capacity control valve according to a second embodiment.

Similarly to the capacity control valves according to the above embodiments, this capacity control valve 60 as well is configured such that the diameter of a valve hole of a low pressure-side valve seat 28 is made larger in size than that of a valve hole of a high pressure-side valve seat 25, i.e. A<B holds. In the capacity control valve 60, a valve element 22 having a high-pressure valve element 23 and a low-pressure valve element 24 integrally formed therewith is held in a manner movable along the axis of a body 21 by a guide 61 which is integrally formed with a plug 26 forming a valve seat 25 for the high-pressure valve element 23. The guide 61 has a communication hole 62 for communicating between a port 33 communicating with the pressure-regulating chamber 1 and a space accomodating a spring 29. It should be noted that a solenoid arranged below the low-pressure valve element 24, as viewed in the figure, and a mechanism for urging the valve element 22 by the solenoid via a shaft 30 are constructed similarly to those of the capacity control valve 11 according to the first embodiment shown in FIG. 2.

In the capacity control valve 60 having the three-way valve structure described above, when no control current is supplied to a solenoid coil 47 of the solenoid, as shown in FIG. 5, the high-pressure valve element 23 between the discharge pressure Pd and the pressure Pc in the pressure-regulating chamber 1 is fully opened, whereas the low-pressure valve element 24 between the pressure Pc in the pressure-regulating chamber 1 and the suction pressure Ps is fully closed. A movable core 42 of the solenoid is held away from a fixed core 36 due to a balance between spring loads of springs 29, 45, 46. Therefore, the pressure Pc of the pressure-regulating chamber 1 becomes close to the discharge pressure Pd, which minimizes the difference between pressures applied to the both end faces of the piston 6. As a result, the wobble plate 4 is controlled to an angle of inclination which minimizes the stroke of the pistons 6, whereby the variable displacement compressor is switched to the minimum capacity operation.

When a maximum control current is supplied to the solenoid coil 47 of the solenoid, the movable core 42 is attracted by the fixed core 36 to be moved upward, as viewed in the figure, whereby the three-way valve has the high-pressure valve element 23 thereof fully close the passage associated therewith and the low-pressure valve element 24 thereof fully open the passage associated therewith. Then, in addition to a very small amount of refrigerant having been guided out from the pressure-regulating chamber 1 into the suction chamber 9 via the orifice 13, refrigerant in the pressure-regulating chamber 1 is guided into the suction chamber 9 via the three-way valve. Therefore, the pressure Pc of the pressure-regulating chamber 1 becomes closer to the suction pressure Ps, which maximizes the difference between pressures applied to the both end faces of the piston 6. As a result, the wobble plate 4 is controlled to an angle of inclination which maximizes the stroke of the pistons 6, whereby the variable displacement compressor is switched to the maximum capacity operation.

During normal control in which a predetermined control current is supplied to the solenoid coil 47 of the solenoid, the movable core 42 is attracted by the fixed core 36 to be moved upward, as viewed in the figure, according to the magnitude of the control current. Therefore, when the high-pressure valve element 23 is in the closed state, only on condition that the differential pressure between the discharge pressure Pd and the suction pressure Ps becomes larger than a value set according to the magnitude of the control current, the high-pressure valve element 23 starts to be opened, thereby starting the capacity control.

In the above embodiments, descriptions are given assuming that the effective pressure-receiving area of the high pressure-side valve is approximately equal to the cross-sectional area of the valve hole of the valve during most of control time in actual operation. However, if the average cross-sectional area a of a refrigerant passage of the high pressure-side valve assumed when the high-pressure valve element 23 is open is too large to be negligible in actual operation, the cross-sectional area of a valve hole of the low pressure-side valve is configured such that the effective pressure-receiving area of the low pressure-side valve is equal to a value obtained by subtracting therefrom the average cross-sectional area a of a refrigerant passage of the high pressure-side valve assumed when the high-pressure valve element 23 is open.

As described hereinbefore, according to the present invention, the cross-sectional area of a valve hole of a low pressure-side valve of a three-way valve is configured to be larger than that of a valve hole of a high pressure-side valve. This makes the effective pressure-receiving area of the high pressure-side valve and that of the low pressure-side valve approximately equal to each other during control time of actual operation, whereby the influence of pressure from the pressure-regulating chamber on the high-pressure valve element and the low-pressure valve element of the three-way valve can be cancelled out, to obtain characteristics excellent in differential pressure properties.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A capacity control valve for a variable displacement compressor, for controlling an amount of refrigerant introduced from a discharge chamber into a pressure-regulating chamber, such that differential pressure between a pressure in a suction chamber and a pressure in the discharge chamber is held at a predetermined differential pressure, to thereby change a volume of the refrigerant discharged from the variable displacement compressor, comprising:

a first valve inserted into a first refrigerant passage between a first port communicating with the discharge chamber and a second port communicating with the pressure-regulating chamber, for opening and closing the first refrigerant passage; and a second valve inserted into a second refrigerant passage between the second port communicating with the pressure-regulating chamber and a third port communicating with the suction chamber, a valve hole of the second valve having a larger diameter than a valve hole of the first valve, for opening and closing the second refrigerant passage in conjunction with the first valve.

2. The capacity control valve according to claim 1, wherein the valve hole of the second valve is configured to have such a diameter that the valve hole of the second valve has an area equal to a sum of an effective pressure-receiving area of the first valve and an average cross-sectional area of a refrigerant passage of the second valve assumed when the second valve is open.

3. The capacity control valve according to claim 1, wherein a first valve element of the first valve and a second valve element of the second valve are arranged on axially both sides along the same axis, and at the same time integrally formed with each other.

4. The capacity control valve according to claim 1, including a solenoid for applying a load to the first valve in a valve-closing direction, and to the second valve in a valve-opening direction, the load being dependent on a value of supply current.

5. A capacity control valve for a variable displacement compressor, for controlling an amount of refrigerant introduced from a discharge chamber into a pressure-regulating chamber, such that differential pressure between a pressure in a suction chamber and a pressure in the discharge chamber is held at a predetermined differential pressure, to thereby change a volume of the refrigerant discharged from the variable displacement compressor, comprising:

a first valve inserted into a first refrigerant passage between a first port communicating with the discharge chamber and a second port communicating with the pressure-regulating chamber, for opening and closing the first refrigerant passage; and a second valve inserted into a second refrigerant passage between a third port extending from the pressure-regulating chamber to an upstream side of the second valve, formed separately from the second port, and a fourth port communicating with the suction chamber, a valve hole of the second valve having a larger diameter than a valve hole of the first valve, for opening and closing the second refrigerant passage in conjunction with the first valve.

6. The capacity control valve according to claim 5, wherein the valve hole of the second valve is configured to have such a diameter that the valve hole of the second valve has an area equal to a sum of an effective pressure-receiving area of the first valve and an average cross-sectional area of a refrigerant passage of the second valve assumed when the second valve is open.

7. The capacity control valve according to claim 5, wherein a first valve element of the first valve and a second valve element of the second valve are arranged on axially both sides along the same axis, and at the same time integrally formed with each other.

8. The capacity control valve according to claim 5, including a solenoid for applying a load to the first valve in a valve-closing direction, and to the second valve in a valve-opening direction, the load being dependent on a value of supply current.

* * * * *